US011445755B2

(12) United States Patent
Reevell

(10) Patent No.: US 11,445,755 B2
(45) Date of Patent: Sep. 20, 2022

(54) AEROSOL-GENERATING SYSTEM AND DEVICE

(71) Applicant: PHILIP MORRIS PRODUCTS S.A., Neuchatel (CH)

(72) Inventor: Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 521 days.

(21) Appl. No.: 16/481,228

(22) PCT Filed: Jan. 30, 2018

(86) PCT No.: PCT/EP2018/052183
§ 371 (c)(1),
(2) Date: Jul. 26, 2019

(87) PCT Pub. No.: WO2018/141699
PCT Pub. Date: Aug. 9, 2018

(65) Prior Publication Data

US 2019/0387799 A1 Dec. 26, 2019

(30) Foreign Application Priority Data

Jan. 31, 2017 (EP) ..... 17153927

(51) Int. Cl.
*A24F 40/46* (2020.01)
*H05B 3/06* (2006.01)
(Continued)

(52) U.S. Cl.
CPC ..... *A24F 40/46* (2020.01); *A24F 40/30* (2020.01); *H05B 3/06* (2013.01); *A24F 40/20* (2020.01); *H05B 2203/021* (2013.01)

(58) Field of Classification Search
CPC ..... A24F 40/42; A24F 40/465
See application file for complete search history.

(56) References Cited

U.S. PATENT DOCUMENTS 2,528,619 A 11/1950 Stein
3,526,751 A 9/1970 Climent
(Continued)

FOREIGN PATENT DOCUMENTS

CN 204907924 12/2015
CN 105333455 2/2016
(Continued)

OTHER PUBLICATIONS

PCT Search Report and Written Opinion for PCTZEP2018/052183 dated Apr. 27, 2018 (11 pages).
(Continued)

*Primary Examiner* — Jean F Duverne
(74) *Attorney, Agent, or Firm* — Mueting Raasch Group

(57) ABSTRACT

The aerosol-generating system comprises an aerosol-generating device comprising a first receiving chamber (10) and a second receiving chamber (11). The first receiving chamber (10) and the second receiving chamber (11) are arranged side-by-side in a device housing (1). A first solid substrate containing rod (30) is arranged in the first receiving chamber (10) and a second solid substrate containing rod (31) is arranged in the second receiving chamber (11). At least the first or second receiving chamber (10,11) comprises a heater (6) for heating at least the first or the second solid substrate containing rod (30,31) accommodated in the respective receiving chamber (10,11).

19 Claims, 2 Drawing Sheets

(51) Int. Cl.
*A24F 40/30* (2020.01)
*A24F 40/20* (2020.01)

(56) References Cited

U.S. PATENT DOCUMENTS

| | | | | |
|---|---|---|---|---|
| 4,342,902 | A | 8/1982 | Ping | |
| 4,621,649 | A | 11/1986 | Osterrath | |
| 5,505,214 | A * | 4/1996 | Collins | H05B 3/24 131/194 |
| 8,997,753 | B2 * | 4/2015 | Li | A24F 40/485 131/273 |
| 9,302,825 | B2 * | 4/2016 | Liu | B65D 43/22 |
| 9,499,332 | B2 * | 11/2016 | Fernando | H02J 7/0027 |
| 9,851,104 | B2 * | 12/2017 | Damiani | A24D 1/08 |
| 10,085,482 | B2 | 10/2018 | Silvestrini | |
| 10,226,079 | B2 | 3/2019 | Robinson | |
| 10,399,730 | B2 | 9/2019 | Habibi-Naini | |
| 2012/0048266 | A1 | 3/2012 | Alelov | |
| 2013/0014772 | A1 | 1/2013 | Liu | |
| 2013/0333700 | A1 | 12/2013 | Buchberger | |
| 2014/0060556 | A1 | 3/2014 | Liu | |
| 2014/0305448 | A1 | 10/2014 | Zuber | |
| 2016/0361678 | A1 * | 12/2016 | Blackley | A24F 40/51 |
| 2017/0013875 | A1 | 1/2017 | Schennum | |

FOREIGN PATENT DOCUMENTS

| | | |
|---|---|---|
| EP | 2844088 | 3/2015 |
| JP | H07-184627 | 7/1995 |
| JP | 2010-506594 | 3/2010 |
| JP | 2016-523096 | 8/2016 |
| RU | 2585552 | 5/2016 |
| WO | WO 2013/116572 | 8/2013 |
| WO | WO 2015/176898 | 4/2015 |
| WO | WO 2015/179388 | 11/2015 |

OTHER PUBLICATIONS

Office Action issued in China for Application No. 2019127174 dated Jun. 3, 2021 (17 pages). English translation included.
Office Action issued in Japan for Application No. 2019-561356 dated Feb. 21, 2022 (8 pages). English translation included.

* cited by examiner

AEROSOL-GENERATING SYSTEM AND DEVICE

This application is a U.S. National Stage Application of International Application No. PCT/EP2018/052183 filed Jan. 30, 2018, which was published in English on Aug. 9, 2018, as International Publication No. WO 2018/141699 A1. International Application No. PCT/EP2018/052183 claims priority to European Application No. 17153927.3 filed Jan. 31, 2017.

The invention relates to aerosol-generating systems and devices using solid substrate containing rods, in particular tobacco rods. In particular, the invention relates to aerosol-generating systems and devices suitable for being used with more than one solid substrate containing rod such as tobacco rods.

Aerosol-generating systems, so called electronic cigarettes, are known to use a liquid to be evaporated or tobacco material to be heated. In some devices the evaporation of a liquid is combined with heating tobacco. In other systems, two cartridges comprising different liquids are provided for selective parallel evaporation of the different liquids.

Thus, there is a need for aerosol-generating systems that provide a user with more possibilities or a choice in using solid substrate containing rods.

According to the invention there is provided an aerosol-generating system comprising an aerosol-generating device comprising a first receiving chamber and a second receiving chamber. The first receiving chamber and the second receiving chamber are arranged side-by-side in a device housing. A first solid substrate containing rod is arranged in the first receiving chamber and a second solid substrate containing rod is arranged in the second receiving chamber. At least one of the first receiving chamber or the second receiving chamber comprises a heater for heating at least the first or the second solid substrate containing rod accommodated in the respective receiving chamber. Preferably, a heating element of the heater is arranged to extend along at least a portion of a length of the respective receiving chamber to heat at least a portion of a length of the respective substrate containing rod arranged in the respective receiving chamber.

With this system, a user is provided with the choice which solid substrate containing rod accommodated in the receiving chamber shall be used, or if both solid substrate containing rods shall be used in parallel and to what extent. Depending on the kind of solid substrate containing rods provided in the receiving chambers a desired consumer experience may be selected. For example, a selection may be made between a flavour-based experience or a nicotine-based experience or possibly both.

The aerosol-generating system allows the use of two or possibly even more different solid substrate containing rods either individually or in combination. A user is provided with the choice which solid substrate containing rods to use. A user is also provided with the choice of different combinations of solid substrate containing rods to use.

When used in combination, the two or more solid substrate containing rods may be used in parallel or individually. In a parallel use an airflow through the tobacco rods is led through both solid substrate containing rods in parallel and may be combined in a mouthpiece before leaving the device.

Substances from a solid substrate containing rod may be transported by an airflow passing through the solid substrate containing rod. These substances may simply be entrained by the passing airflow. For example, an airflow passing a tobacco substrate may be entrained with tobacco flavour.

The substances to be inhaled are also actively generated by heating a solid substrate containing rod and forming an inhalable aerosol.

Preferably, a heating element of the heater is arranged to extend along at least a portion of a length of the respective receiving chamber. By this a solid substrate containing rod may be heated along its length. The solid substrate containing rod may, for example, be heated along a portion of the length of the solid substrate in the rod or along the entire length of the solid substrate in the rod. Preferably, the solid substrate containing rod is heated along the entire length of the solid substrate in the rod.

In the system, preferably, at least the first or the second solid substrate containing rod is heatable along an entire circumference of the rod by the heater comprised in the first or in the second receiving chamber. This may be achieved, for example, by a circumferentially arranged heater or a heater arranged to substantially circumscribe the respective receiving chamber. A substantially circumscribing heater does not have to completely surround the receiving chamber but may comprise, for example, one or several interspaces. An interspace may be arranged between opposite sides of a circumscribing heating element or between several adjacently and circumferentially arranged heating elements of the heater.

With a circumferentially arranged heater a solid substrate containing rod and in particular a tobacco or other aerosol-forming substrate in the rod may very homogenously and effectively be heated. Thus, reproducible and reliable aerosol generation may be achieved. In addition, waste of unused substrate due to ineffective heating, for example in central or in peripheral regions of the rod may be prevented.

These effects may also be achieved with a heater arranged to substantially circumscribe the receiving chamber, thus with a heater comprising interspaces. Interspaces may, for example, have a size of one tenth or a few tenths of a millimeter or also of up to a millimeter.

A circumferential heating is particularly effective when using rods having a small rod diameter.

The solid substrate containing rods used in the system according to the invention may have a same rod diameter or may have different rod diameters.

Using rods having a same diameter may simplify a manufacturing process of the rods. Rods having a same diameter may also be used for doubling the period of a user experience by sequentially using the two rods.

In some embodiments, the first solid substrate containing rod comprises a first rod diameter and the second solid substrate containing rod comprises a second rod diameter, wherein the first rod diameter is larger than the second rod diameter.

Using solid substrate containing rods having different rod diameters may provide further and different applications of solid substrate containing rods than, for example using solid substrate containing rods of a same size. For example, slower or reduced heating may be provided in the larger rod and faster or more efficient heating may be provided in the smaller rod with corresponding aerosol-generation and flavour release.

Differently sized rods may also simplify application by providing only one possibility with respect to a receiving chamber the rod is to be inserted.

Preferably, diameters of solid substrate containing rods and diameters of respective receiving chambers have corresponding sizes such that the solid substrate containing rod fits into the receiving chamber without being squeezed and without sitting loose in the receiving chamber. Preferably, a small frictional force is required to insert a solid substrate containing rod in and to remove the same from a receiving chamber.

Advantageously, diameters of solid substrate containing rods and diameters of receiving chambers accordingly, are kept small. Preferably, two receiving chambers arranged side-by-side adjacent each other are not or not significantly larger than a receiving chamber for conventionally sized solid substrate containing rods. Smaller receiving chambers and smaller rods accordingly may provide a very efficient heating down to a center of the rod. In addition, sizes of known devices for one solid substrate containing rod need not be enlarged. In particular, if two receiving chamber diameters are sufficiently small, a conventional mouthpiece may be used for covering both rods and aerosol inhalation from both rods.

Preferably, at least the first or the second chamber diameter is smaller than 7 millimeter, more preferably smaller than 5 millimeter. At least the first or the second chamber diameter may, for example, be in a range between 2 millimeter and 7 millimeter, preferably in a range between 2 millimeter and 5 millimeter, or between 2 millimeter and 3.5 millimeter.

Preferably, the first and the second chamber diameters are in the above given ranges.

Thus, a total extension of the first and the second chamber diameters of the receiving chambers arranged side-by-side are preferably smaller than 15 millimeter, more preferably smaller than 12 millimeter, for example between 5 millimeter and 10 millimeter.

The solid substrate containing rods may entirely be received within the receiving chamber. Alternatively, the solid substrate containing rods may extend from the receiving chambers when accommodated therein.

Preferably, the solid substrate containing rods extend from the receiving chamber to allow gripping of the extending portion of the rods for pulling the rods out of the receiving chambers after use. The first and the second solid substrate containing rods may also extend from the receiving chamber such as to allow drawing on both solid substrate containing rods. An extending portion of the solid substrate containing rods, in particular of tobacco rods, may be a filter or a portion of a filter.

The device may comprise a mouthpiece, which mouthpiece in a closed position, that is, when the mouthpiece is mounted on the device housing and closes the receiving chambers, the mouthpiece covers the first and the second solid substrate containing rod. By this, individual or parallel use of either one of the solid substrate containing rods through the one mouthpiece is possible.

The solid substrate containing rods may be tobacco rods such as, for example tobacco plugs comprising homogenized or reconstituted tobacco material, for example tobacco sheets that are crimped and gathered into a rod shape. The tobacco rods or other aerosol-forming solid substrate containing rods may comprise vaporisable wax to alter aerosol generation, or flavour containing materials or capsules.

Solid substrate containing rods used in the system may be identical or be different. Different solid substrate containing rods may differ in size, for example, in a rod diameter. Preferably, different solid substrate containing rods contain any one or a combination of different tobacco material, different flavour, different nicotine content or different substance combination.

In some preferred embodiments, the first solid substrate containing rod comprises tobacco and nicotine and the second solid substrate containing rod comprises a flavour, preferably a flavour other than tobacco flavour or an additional flavour such as for example menthol. The second solid substrate containing rod may contain no tobacco material. Preferably, a first solid substrate containing rod comprises flavour but no nicotine, while a second solid substrate containing rod comprises nicotine.

In the system, one solid substrate containing rod may be heated and one solid substrate containing rod may not be heated. Alternatively, both solid substrate containing rods may be heated.

A third or further solid substrate containing rod may be accommodated in the device housing. The device housing may accordingly comprise a third or further receiving chamber for receiving and accommodating the third or further solid substrate containing rod.

Advantageously, the system comprises two or more solid substrate containing rods arranged side-by-side in the device housing. Preferably, two solid substrate containing rods are arranged side-by-side in the device housing and the device housing comprises two receiving chambers only.

Preferably, a mouthpiece covers all solid substrate containing rods in the device.

According to the invention there is also provided an aerosol-generating device. The device comprises a device housing comprising a first receiving chamber for receiving and accommodating a first solid substrate containing rod and a second receiving chamber for receiving and accommodating a second solid substrate containing rod. The first receiving chamber and the second receiving chamber are arranged side-by-side in the device housing. At least the first receiving chamber or the second receiving chamber comprises a heater for heating a solid substrate containing rod accommodated in the respective receiving chamber. Preferably, a heating element of the heater is arranged to extend along at least a portion of a length of the respective receiving chamber to heat at least a portion of a substrate containing rod accommodated in the receiving chamber. The heating element may be arranged to extend along a portion of the length, which portion is smaller than the entire length of the receiving chamber. Alternatively, the heating element may be arranged to extend along the entire length of the respective receiving chamber.

Preferably, the heater is arranged to substantially circumscribe or surround the respective receiving chamber. Thus, a heating element of the heater substantially or entirely circumscribes the receiving chamber.

Advantages of such a device have already been described relating to the system according to the invention.

Preferably, the first and the second receiving chamber comprise a heater for heating a solid substrate containing rod accommodated in the respective receiving chamber.

Therein, a heating element of each heater may be arranged to extend along at least a portion of a length of each respective receiving chambers to heat at least a portion of a substrate containing rod accommodated in each respective receiving chamber.

A heating element of each heater may be arranged to extend along the entire length of each respective receiving chambers to heat the portion of the substrate containing rod or the entire rod, which is accommodated in each respective receiving chamber.

The heater or each heater may be arranged to substantially circumscribe or surround or entirely circumscribe or surround the respective receiving chamber(s).

Preferably, a heater is a resistively heatable heater or an inductor for inductively heating a substrate in the solid substrate containing rod. For example, metal wires or an induction coil may be arranged circumferentially in a receiving chamber wall such as to surround a solid substrate containing rod accommodated in the receiving chamber. A susceptor material inductively heated by an inductor may be provided in the receiving chamber or in a solid substrate containing rod.

Preferably, a susceptor material is provided in the receiving chamber.

The first receiving chamber comprises a first chamber diameter and the second receiving chamber comprises a second chamber diameter. The first and the second chamber diameters may be equal or may be different. For example, the first chamber diameter may be larger than the second chamber diameter or vice versa. Accordingly, differently sized solid substrate containing rods may be accommodated in the first and in the second receiving chamber.

The device may comprise a mouthpiece, which may removably be connectable to the device housing. In a removed position of the mouthpiece access to the receiving chambers is provided. When mounted to the device housing, the mouthpiece is in a closed position: the receiving chambers are closed by the mouthpiece and solid substrate containing rods accommodated in the receiving chambers are covered by the mouthpiece. The first receiving chamber comprises a receiving opening and the second receiving chamber comprises a receiving opening.

In a closed position of the mouthpiece, the mouthpiece covers the first receiving opening of the first receiving chamber and covers the second receiving opening of the second receiving chamber.

The mouthpiece may be connected to the device housing in a hinged manner such that in an open position of the mouthpiece, access to the receiving chambers is provided.

The device may comprise an indicator, indicating the receiving chamber comprising the heater. Advantageously an indicator is provided when only one receiving chamber comprises a heater. If more than two receiving chambers are provided, an indicator preferably indicates all receiving chambers comprising a heater. Thus, the indicator may indicate where a heatable solid substrate containing rod is to be inserted into the device.

An indicator may, for example, be a drawn indicator, a printed indicator or a tactile indicator. Preferably, the indicator is a coloured area arranged at or around a receiving chamber opening of the receiving chamber comprising the heater.

The device housing may comprise a third or further receiving chamber for receiving and accommodating a third or further solid substrate containing rod. The third or further solid substrate containing rod may be the same or different from the first and second solid substrate containing rods. The third or further receiving chamber may comprise a heater for heating the third or further solid substrate containing rod.

Preferably, all receiving chambers are arranged side-by-side in a device housing. The receiving chambers may be arranged along a straight line.

The device may comprise a control for controlling operation of the device. In particular, the control is configured to control a heating of the solid substrate containing rods. For example, the control controls a power supply to a heater in the receiving chamber. The control may also control a charging status of a power source of the device, a presence or absence of a rod in a receiving chamber, or an operation mode of specific solid substrate containing rods.

In particular, the control is configured to operate all solid substrate containing rods in the device. The control may be configured to operate one or two, preferably all, solid substrate containing rods in the device in combination. A control may be configured to vary a heating process of one or two solid substrate containing rods according to a user's choice. Thus, one solid substrate containing rod may be used more intensely than another rod at one time while using the one solid substrate containing rod less intensely than the other solid substrate containing rod at another time. The device may be provided with respective adjustment input means. Two solid substrate containing rods, in particular two identical rods may be used sequentially. By this, a user experience may be doubled compared to a single rod only.

The device may further comprise an activation button for activating the device by a user.

While only one solid substrate containing rod may be accommodated in the device, preferably, a first solid substrate containing rod is arranged in the first receiving chamber and a second solid substrate containing rod is arranged in the second receiving chamber. Further receiving chambers may be available and further solid substrate containing rods may be arranged in the further receiving chambers.

Preferably, the aerosol-generating device according to the invention and as described herein is used in the aerosol-generating system according to the invention.

The invention is further described with regard to embodiments, which are illustrated by means of the following drawings, wherein.

In the drawings the same reference numbers are used for the same or similar elements.

Figure 1:
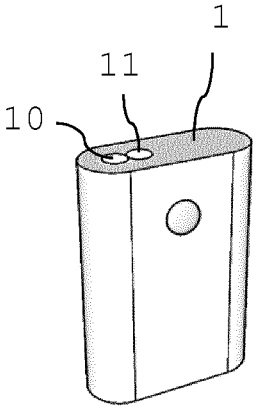
FIGS. 1-4 show an aerosol-generating system with one or two solid substrate containing rods accommodated in a device.
Figure 2:
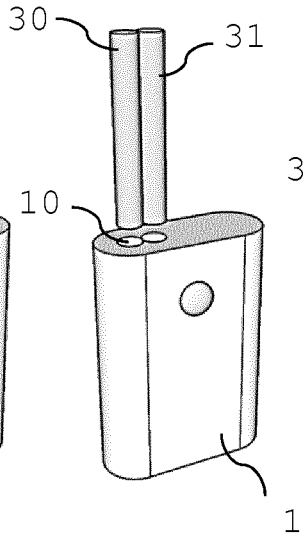
Figure 3:
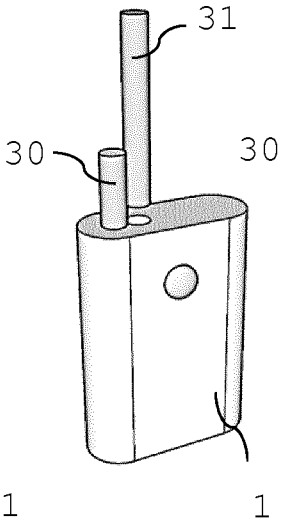
Figure 4:
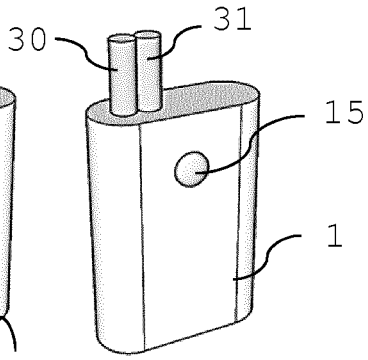

The aerosol-generating device shown in FIG. 1 comprises a device housing 1 having two tubular shaped receiving chambers 10,11 arranged side-by-side in the device housing 1. The receiving chambers 10,11 are sized to accommodate two solid substrate containing rods as shown in FIG. 2. The solid substrate containing rods are not entirely accommodated in the receiving chambers 10, solid substrate containing but extend therefrom as shown in FIG. 3 and FIG. 4. The solid substrate containing rods 30,31 are arranged adjacent each other such that a user may directly draw on the ends of the rods extending from the receiving chambers. Alternatively, a mouthpiece (not shown) may be arranged to cover the extending ends of the solid substrate containing rods 30,31.

Preferably, the solid substrate containing rods 30,31 are aerosol-generating tobacco rods comprising aerosol-forming tobacco substrate. The rods preferably comprise loose tobacco, cut filler of extruded tobacco or homogenised tobacco sheets that have been crimped and gathered to form the rods as is known in the art.

Preferably, the solid substrate containing rods 30,31 comprise a different content. A first solid substrate containing rod 30 may, for example, be unflavoured or contain tobacco flavour and nicotine. A second solid substrate containing rod 31 may, for example, be a flavour but no nicotine containing rod. The flavour may, for example, be different from tobacco flavour such as menthol.

The device housing comprises an activation button 15 for activating the device. Alternatively or in addition, the device may comprise a breath activated switch.

The device housing 1 basically has the form of a flat cylinder. Preferably, the size of the housing 1 is selected such that the two solid substrate containing rods 30,31 may be arranged side-by-side in the housing 1 and next to a power source 16. As shown in the cross sectional view of FIG. 5 and FIG. 6, the device comprises a power source 16 such as a battery or power cell and a control 17 indicated by rectangles.

Figure 5:
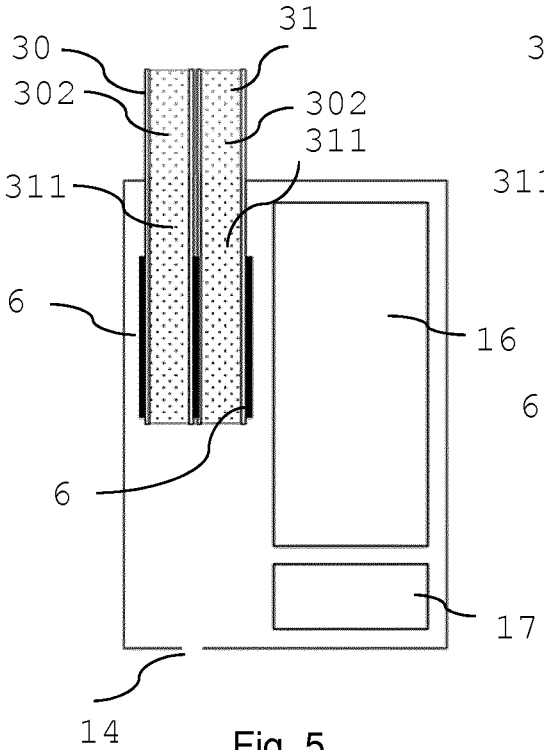
FIG. 5 shows a cross section of an aerosol-generating device comprising two heatable receiving chambers.

In the cross sectional view of FIG. 5, heating elements 6 are drawn as black lines along a portion of the length of the receiving chambers 10,11. Each receiving chamber is provided with a heating element 6, for example a resistively heatable heating element, for heating the solid substrate containing rod 30,31 accommodated in the respective receiving chamber 10, 11. The heating elements extend around the circumference of the receiving chambers for a homogeneous heating of the tobacco rods 30,31.

Figure 6:
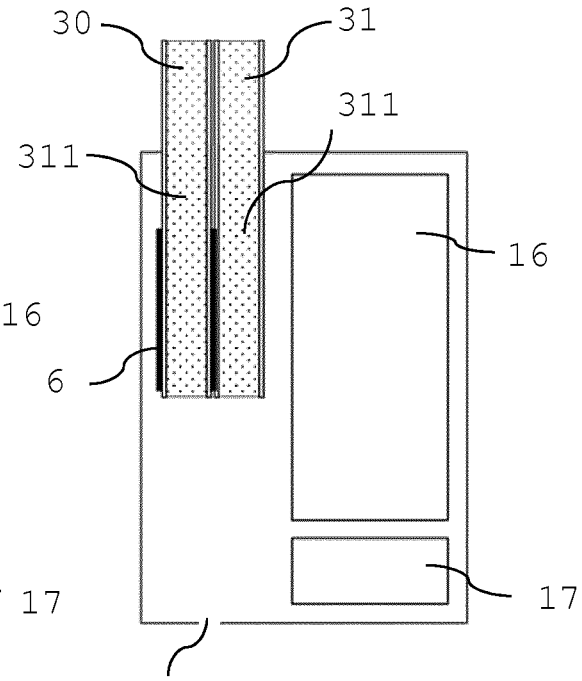
FIG. 6 shows a cross section of an aerosol-generating device comprising one heatable receiving chamber.

In FIG. 5 and FIG. 6 the rods are depicted as tobacco rods comprising a tobacco substrate 311. The tobacco substrate 311 of the two rods may be identical enabling an extending of a user experience when the tobacco rods are used sequentially one after the other.

In particular, slim tobacco rods having a diameter of about 5.3 millimeter may be used in receiving chambers 10,11 having a slightly larger cross section. Such slim tobacco rod allow for only about 3 to 4 puffs. By sequentially using two tobacco rods a puffing experience may be extended to last about 8 puffs, which corresponds to a smoking experience of a conventional cigarette.

An end portion of the rods, for example the portion extending from the receiving chambers 10,11 may comprise a filter element 302.

The heating elements preferably extend over about at least half of the length of the receiving chamber. In the example shown in FIG. 5 and FIG. 6, the heating elements 6 extend over more than 50 percent of the length of the receiving chambers. The heating elements may extend over substantially the entire length of the receiving chamber.

The device housing 1 comprises an air inlet 14 in the bottom of the housing, where an airflow may enter the device housing 1, then enter the bottom of the receiving chambers 10,11 to pass though the tobacco rods and be guided to a user.

In FIG. 6 only the first receiving chamber 10 comprises a heating element 6. The tobacco rod 30 in the first receiving chamber is heated to generate an inhalable aerosol. The rod in the second receiving chamber 11 is not heated. Preferably, the second rod comprises a flavour that is entrained by the passing airflow.

Figure 7:
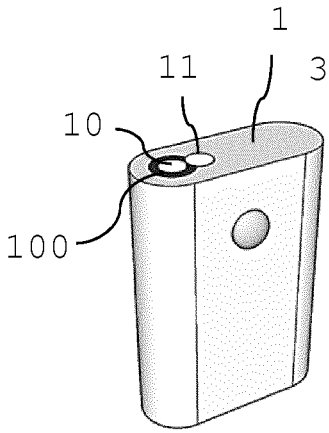
FIGS. 7-10 show an aerosol-generating device comprising an indicator to a heatable and a non-heatable receiving chamber.

FIG. 7 shows an embodiment of a device having one heatable receiving chamber only, for example as shown in the cross sectional view of FIG. 6. The heatable first receiving chamber 10 is provided with an indicator 100. The indicator is in this embodiment a coloured ring printed or painted around the receiving opening of the first receiving chamber 10. The indicator 100 indicates the heatable receiving chamber and indicates a user where to place a specific to be heated solid substrate containing rod.

Figure 8:
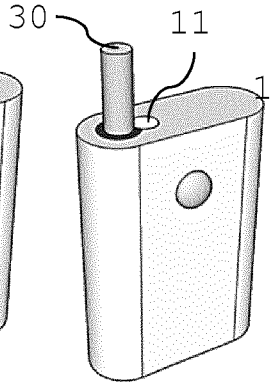
Figure 9:
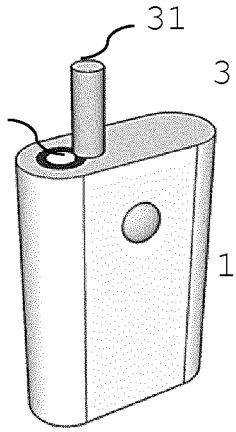
Figure 10:
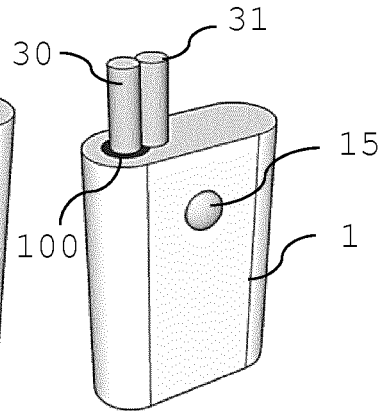

In FIG. 8 a solid substrate containing rod 30 is inserted into the heatable first receiving chamber. In FIG. 9 a solid substrate containing rod 31 is inserted into the non-heatable second receiving chamber. In FIG. 10 a solid substrate containing rod 30,31 is inserted into each of the two receiving chambers such that a consumer experience may comprise substances from a heated solid substrate such as a tobacco substrate and from a non-heated solid substrate such as a flavoured substrate.

Figure 11:
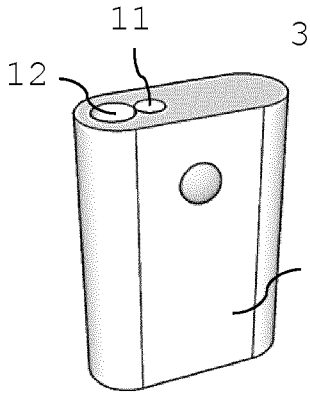
FIGS. 11, 12 show an aerosol-generating device having two differently sized receiving chambers (FIG. 11) comprising differently sized tobacco rods (FIG. 12)
Figure 12:
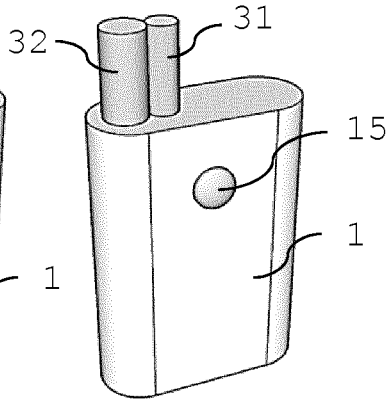

FIG. 11 shows an embodiment of an aerosol-generating device comprising two differently sized receiving chambers 12,11. A larger first receiving chamber 12 may accommodate a thicker solid substrate containing rod 32 as shown in FIG. 12. A thinner solid substrate containing rod 31 is arranged in the second receiving chamber 11.

A thicker rod may preferably be used in a heated receiving chamber for nicotine and aerosol-formation, while the smaller rod is preferably used for providing unheated flavour. A non-heated substrate may be a no tobacco material containing rod.

However, both chambers may be heated. In such embodiments the smaller rod may be subject to more heating than the larger rod and thus may be used for increased vapour or nicotine production.

Figure 13:
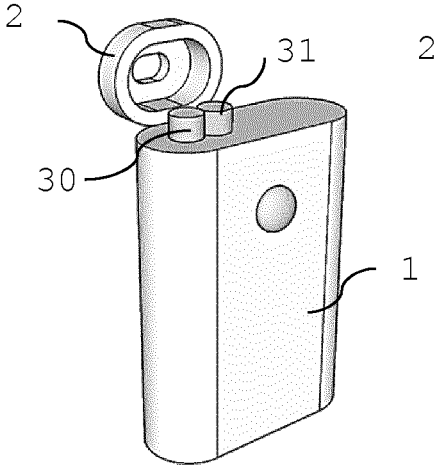
FIG. 13 shows the device comprising a hinged mouthpiece.
Figure 14:
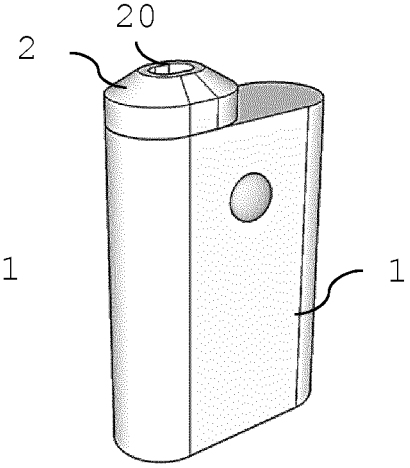
FIG. 14 shows the device with closed mouthpiece.

In FIG. 13 and FIG. 14 a device comprising a device housing 1 and a mouthpiece 2 is shown. The mouthpiece 2 is connected to the housing 1 in a hinged manner as shown in FIG. 13 in the open position. The rods 30,31 extend only slightly from the receiving chambers. By this, only little space is used in the mouthpiece 2 and the mouthpiece may accordingly be constructed small and in a space saving manner. On the other hand, the portions of the rods extending from the receiving chambers may serve for removal of the rods after use by gripping the end portions.

The mouthpiece 2 has an oval shape and is preferably arranged and positioned to be arranged flush on three sides with the device housing 1. The mouthpiece in FIG. 14 is shown in the mounted or closed position. In the closed position, the mouthpiece 2 covers both openings of the receiving chambers and both solid substrate containing rods 30,31 accommodated in the receiving chambers.

In the application a heater is referred to as comprising a heating element. A heater may comprise one or several heating elements. A control in the device may be configured to allow for an individual heating of the one or the several heating elements.

The invention claimed is:

1. Aerosol-generating system comprising an aerosol-generating device comprising a first receiving chamber and a second receiving chamber, wherein the first receiving chamber and the second receiving chamber are arranged side-by-side in a device housing, wherein a first solid substrate containing rod is arranged in the first receiving chamber, and wherein a second solid substrate containing rod is arranged in the second receiving chamber, wherein at least one of the first receiving chamber or of the second receiving chamber comprises a heater for heating at least the first or the second solid substrate containing rod accommodated in the respective receiving chamber, and wherein a heating element of the heater is arranged to extend over at least half of a length of the respective receiving chamber to heat at least a portion of a length of the respective substrate containing rod arranged in the respective receiving chamber.

2. System according to claim 1, wherein at least the first or the second solid substrate containing rod is heatable along an entire circumference of the rod by the heater comprised in the first or in the second receiving chamber.

3. System according to claim 1, wherein the first solid substrate containing rod comprises a first rod diameter and wherein the second solid substrate containing rod comprises a second rod diameter, and wherein the first rod diameter is larger than the second rod diameter.

4. System according to claim 1, wherein the first receiving chamber comprises a first chamber diameter and wherein the second receiving chamber comprises a second chamber diameter, and wherein at least the first or the second chamber diameter is smaller than 7 millimeter.

5. System according to claim 4, wherein the total extension of the first and the second chamber diameters of the receiving chambers arranged side-by side is smaller than 15 millimeter.

6. System according to claim 1, wherein the first and the second solid substrate containing rods extend from the receiving chamber.

7. System according to claim 1, wherein the first solid substrate containing rod comprises tobacco and nicotine and wherein the second solid substrate containing rod comprises a flavour.

8. System according to claim 1, comprising a mouthpiece, wherein the mouthpiece in a closed position covers the first and the second solid substrate containing rod.

9. Aerosol-generating system according to claim 1, wherein the first and second receiving chamber each comprises an open proximal end arranged at a proximal end of the device housing for receiving the respective first and second solid substrate containing rod.

10. Aerosol-generating system according to claim 9, wherein the first and second receiving chamber each extend from the proximal end of the device housing into the interior of the device housing.

11. Aerosol-generating device comprising a device housing comprising a first receiving chamber for receiving and accommodating a first solid substrate containing rod and a second receiving chamber for receiving and accommodating a second solid substrate containing rod, wherein the first receiving chamber and the second receiving chamber are arranged side-by-side in the device housing, wherein at least the first receiving chamber or the second receiving chamber comprises a heater for heating a solid substrate containing rod accommodated in the respective receiving chamber, and wherein a heating element of the heater is arranged to extend over at least half of a length of the respective receiving chamber to heat at least a portion of a substrate containing rod accommodated in the respective receiving chamber.

12. Device according to claim 11, wherein the heater is arranged to circumscribe the respective receiving chamber.

13. Device according to claim 11, wherein the first and the second receiving chamber comprise a heater for heating a solid substrate containing rod accommodated in the respective receiving chamber, wherein each heater is arranged to circumscribe the respective receiving chamber.

14. Device according to claim 11, wherein the first receiving chamber comprises a first chamber diameter, and wherein the second receiving chamber comprises a second chamber diameter, and wherein the first and the second chamber diameters are equal.

15. Device according to claim 11, wherein the first receiving chamber comprises a first chamber diameter, and wherein the second receiving chamber comprises a second chamber diameter, and wherein the first chamber diameter is larger than the second chamber diameter.

16. Device according to claim 11 comprising a mouthpiece, wherein the first receiving chamber comprises a receiving opening and the second receiving chamber comprises a receiving opening and wherein the mouthpiece when in a closed position covers the receiving opening of the first receiving chamber and covers the receiving opening of the second receiving chamber.

17. Device according to claim 11, comprising an indicator, indicating the receiving chamber comprising the at least one heater.

18. Aerosol-generating device according to claim 11, wherein the first and second receiving chamber each comprises an open proximal end arranged at a proximal end of the device housing for receiving the respective first and second solid substrate containing rod.

19. Aerosol-generating device according to claim 18, wherein the first and second receiving chamber each extend from the proximal end of the device housing into the interior of the device housing.

* * * * *